US007242788B2

(12) United States Patent
Simidian, II et al.

(10) Patent No.: US 7,242,788 B2
(45) Date of Patent: Jul. 10, 2007

(54) SECURING MAGNETS IN HIGH-EFFICIENCY PLANAR MAGNETIC TRANSDUCERS

(75) Inventors: Vahan Simidian, II, Newport Beach, CA (US); Dragoslav Colich, Costa Mesa, CA (US)

(73) Assignee: HPV Technologies, LLC, Costa Mesa, CA (US)

( * ) Notice: Subject to any disclaimer, the term of this patent is extended or adjusted under 35 U.S.C. 154(b) by 201 days.

(21) Appl. No.: 10/919,018

(22) Filed: Aug. 16, 2004

(65) Prior Publication Data

US 2006/0034480 A1 Feb. 16, 2006

(51) Int. Cl.
*H04R 1/02* (2006.01)

(52) U.S. Cl. ..... 381/432; 381/386

(58) Field of Classification Search ..... None
See application file for complete search history.

(56) References Cited

U.S. PATENT DOCUMENTS

2002/0191808 A1* 12/2002 Croft et al. ..... 381/431
2004/0140545 A1* 7/2004 Farnworth et al. ..... 257/678

OTHER PUBLICATIONS

"Speakers: Dynamic Speaker Alternatives: Planar-Magnetic Speakers", http://www.audiovideo101.com/learn/knowit/speakers/speakers08.asp.
Anthony Armstrong, "Different Types of Speaker", Understanding Different Types of Loudspeaker, http://stereos.about.com/cs/componentguide/a/loudspeakers_2.htm.
"Frequently Asked Ques", MAD Magnetic Audio Devices-Muzikbox-Planar Magnetic Surface Arrays from HPV T . . . , http://www.getmad.us/FAQ.html.
"What is MAD?", MAD Magnetic Audio Devices-Muzibox-Planar Magnetic Surface Arrays from HPV T . . . , http://getmad.us?WhatIsMAD.html.

* cited by examiner

*Primary Examiner*—Sinh Tran
*Assistant Examiner*—Walter F Briney, III
(74) *Attorney, Agent, or Firm*—Fish & associates, PC

(57) ABSTRACT

In an audio system, cyanoacrylate adhesive can reliably hold neodymium magnets to a stator for a planar magnetic transducer when the transducer generates high output. In one implementation, the planar magnetic transducer can include multiple neodymium magnets aligned in rows on top of a stator. Each neodymium magnet may be aligned with another neodymium magnet, and each pair of neodymium magnets can be separated by a gap. The transducer can have spacers to fill each gap and separate each pair of neodymium magnets. Cyanoacrylate adhesive can bond the neodymium magnets to the stator and bond each spacer between each pair of neodymium magnets.

22 Claims, 5 Drawing Sheets

SECURING MAGNETS IN HIGH-EFFICIENCY PLANAR MAGNETIC TRANSDUCERS

BACKGROUND

In audio speaker design, transducers can be used to change electrical energy into acoustical energy. One type of transducer design may include planar magnetic transducers. Planar magnetic transducers can have an array of magnets located on a substantially planar surface to generate sound at loud volumes (e.g., 90~117 dB sound pressure level) with clear, undistorted sound, even at hundreds of feet away from the transducer. Planar magnetic drivers can be specially designed for professional sound applications. In other implementations, planar magnetic transducers can be used in areas of consumer electronics, such as planar magnetic speakers for the multimedia or home market.

SUMMARY

The present application describes a method for constructing an audio transducer that involves applying cyanoacrylate adhesive on a stator, and attaching multiple magnets on the cyanoacrylate adhesive on the stator. Each magnet is aligned with another magnet, and each pair of magnets is separated by a gap. The method includes allowing the cyanoacrylate adhesive between the stator and each of the magnets to cure to form a bond between the stator and the magnets, and applying a wood spacer between each pair of magnets. The wood spacer occupies the gap and contacts a contact location of each magnet. The method includes applying cyanoacrylate adhesive on a top surface of each the wood spacers, applying cyanoacrylate adhesive at the contact location of each magnet where the wood spacer contacts the magnet, and allowing the cyanoacrylate adhesive at the contact location of each magnet to cure to form a bond between the magnet and the wood spacer.

Also described is a planar magnetic transducer apparatus with a stator and multiple magnets aligned in rows on the stator, in which each pair of magnets is separated by a gap. The apparatus has multiple spacers to fill each gap and separate each pair of magnets, in which each spacer contacts at least one magnet. The apparatus also includes an adhesive to bond the magnets to the stator and to bond each spacer between each pair of magnets.

The present disclosure describes an audio system that includes a planar magnetic transducer to generate high output. The planar magnetic transducer includes multiple neodymium magnets aligned in rows on a stator, in which each neodymium magnet is aligned with another neodymium magnet, and each pair of neodymium magnets is separated by a gap. The transducer has multiple balsa wood spacers to fill each gap and separate each pair of neodymium magnets. Each of the balsa wood spacers contacts at least one neodymium magnet. The transducer includes cyanoacrylate adhesive to bond the neodymium magnets to the stator and to bond each balsa wood spacer between each pair of neodymium magnets.

The systems and techniques described here may provide one or more of the following advantages. The techniques described here for constructing a planar magnetic transducer with spacers between the magnets on a stator may result in a transducer that can use powerful magnets to reliably operate at high output levels and sensitivity. The magnets and the spacers may be bonded to each other and to the stator using, for example, a cyanoacrylate adhesive, such as Krazy Glue™ or Superglue™ or other high strength adhesives. The cyanoacrylate adhesive can serve as an adhesive that has the strength to withstand the vibrational and magnetic forces in the transducer. Furthermore, as the magnets are placed closer together and the distance between the magnets is reduced, the magnetic flux density between the magnets can increase. The increase in the magnetic flux density can increase the sensitivity of the transducer. The spacers between magnets, which are secured with cyanoacrylate adhesive or other high strength adhesives, can permit the smaller distances between the magnets to increase the transducer efficiency. As a result, the magnets can remain reliably attached to the stator despite being closer together. In another advantage, the adhesives can air-cure in seconds or a few minutes.

In other benefits, the spacers between the planar magnets may be made of balsa wood. Balsa wood is able to be compressed and take the shape of the area between the planar magnets. The balsa wood may be compressed and susceptible to a bonder, so that an assembly machine can position the wood between the planar magnets and apply an adhesive for bonding. Because the magnets are aligned in an array, the spaces between the magnets can vary during fabrication of the transducer. The design has an advantage in that the balsa wood is able to fit within the various slots between the magnets regardless of whether the distance between the magnets differ slightly from each other. In this respect, the spacing requirements may be relaxed when placing planar magnets on the stator. When the cyanoacrylate adhesive is applied to the balsa wood spacer, a hard, rigid structure can be formed that reliably separates the magnets and holds the magnets in place.

Details of one or more implementations are set forth in the accompanying drawings and the description below. Other features and advantages will be apparent from the description and drawings, and from the claims.

DRAWING DESCRIPTIONS

Like reference symbols in the various drawings indicate like elements.

DETAILED DESCRIPTION

The following describes various tasks, techniques, and systems relating to one or more methods to design planar magnetic transducers. Planar magnetic transducers can be used in a variety of audio applications, including professional sound applications (e.g., speakers in stadiums), and multimedia and consumer electronics applications (e.g., home or computer speakers). Traditionally, planar magnetic transducers in the consumer market have been too large, fragile, inefficient, and expensive to be used in professional applications. Planar magnetic speakers used in the multimedia market can have a limited bandwidth, power handling, and output capacity to be used in professional audio applications.

High-efficiency professional planar magnetic transducers can use large magnets in close proximity to each other to a produce high magnetic flux density in the plane of the diaphragm. The magnets can be bonded to a stator, and large attracting and repelling forces can exist between magnets. Cyanoacrylate adhesive can be used to glue the magnets to a stator. The cyanoacrylate adhesive bond can be strong enough to keep magnets attached to their locations on the stator for static conditions in the absence of external mechanical shock or movement (e.g., movement that is outside the normal operation of the transducer, such as dropping the stator or nudging the magnets). If external mechanical shock occurs to a planar magnetic transducer, the bond between the magnets and stator may not be strong enough to keep the magnets in their original bonded locations. Due to large magnetic forces between the magnets and/or the outside mechanical shocks, the magnets may become detached from the stator, move across the stator, and become attached to neighboring magnets. In some cases, catastrophic failure can occur and destroy the transducer when multiple magnets become detached from the stator and crush into each other. As a result, an inability to reliably hold the magnets in their original bonded locations on the stator can reduce the reliability of planar magnet transducer for professional uses where the magnets are in close proximity and the magnetic forces between the magnets are large. Reliability for professional use can be improved by using spacer structures to keep the magnets physically separated and to keep the magnets in their original bonded locations on the stator.

Figure 1A:
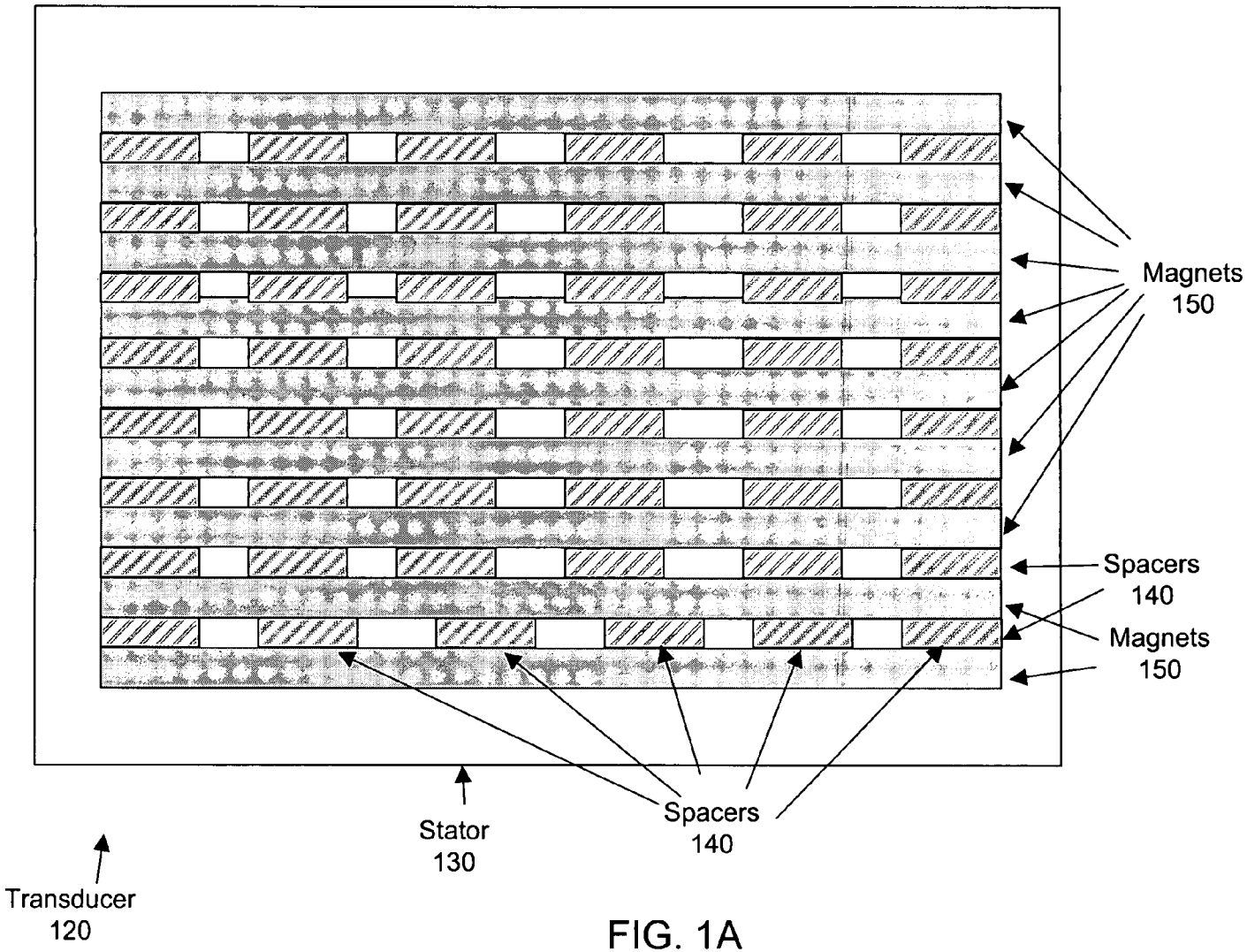
FIG. 1A is a diagram that illustrates a top view of a planar magnetic transducer.

FIG. 1A is a diagram that illustrates a top view of one half of a planar magnetic transducer 120. The transducer 120 includes multiple magnets 150 that are positioned on a stator 130. The stator 130 can be made of steel, but may also be made of other materials, such as plastic or aluminum. Each pair of magnets 120 is separated by a space between the magnets. The attracting and repelling forces of the magnets can be strong, and a spacer structure 140 is placed between the magnets to keep them apart and aligned. The spacers 140 between the magnets can be made of any of a number of materials, including plastics, composites, and wood, or a combination thereof. In one implementation, the spacers 140 are made of balsa wood, which can be easily cut and placed into the area between the magnets.

The magnets can be made from a variety of magnetic materials. One such magnetic material is neodymium, a rare earth metal which can be used in very powerful permanent magnets (e.g., $Nd_2Fe_{14}B$) to create powerful, efficient transducers with little distortion. As stronger and bigger powerful neodymium magnets are added into the transducer to achieve higher levels of sensitivity and output, the magnetic attracting and repelling force between magnets exponentially grows and may cause magnets to become detached from the stator 130. The magnets also may become detached from the stator 130 if the transducer is dropped and/or the magnets are nudged. The magnetic forces can be attractive forces or repelling forces, so when magnets are snapped lose, the magnets may push away from another magnet or be attracted to another magnet. If the magnets snap lose from the stator 130 and attach to one another magnet, the transducer can become unusable. As a result, the failure rate tends to be high for high efficiency planar magnetic transducers with neodymium magnets.

The present disclosure describes a reliable technique to secure the magnets to the stator, and keep the magnets aligned with each other on the stator. An adhesive can be applied between the magnets 150 and the stator 130 to keep the magnets attached to the stator 130. The adhesive can also be applied between the magnets and the spacers 140. The adhesive may also be applied on the balsa wood spacer, so that the balsa wood can absorb at least some of the adhesive and form a hard, rigid spacer between the parallel magnets, and form a reliable joint bond between the wood spacer and magnet.

In one implementation, the adhesive can be cyanoacrylate adhesives, commonly referred to as Krazy glue™ or Superglue™. Cyanoacrylate adhesives are one-part acrylate adhesives that cure on contact with surfaces. Cyanoacrylate adhesives have high strength, and excellent adhesion to a wide variety of substrates, such as plastic, wood, and metal. In another implementation, other types of adhesives may be used, such as reactive adhesives. Epoxy resins are one example of reactive adhesives.

In FIG. 1A, the balsa wood is cut into pieces and positioned in the spaces between the magnets. In general, the balsa wood is cut into pieces that are slightly wider than the distance between the magnets. So when the balsa wood spacer is positioned between the magnets, the wood spacers are squeezed into the gap between the magnets. The balsa wood can be compressed and take the shape of the area between the magnets. During the assembly of the transducer, the distance separating each pair of magnets may not be exactly the same. Because the balsa wood spacer is compressible and can take the shape of the gap, the compressibility of balsa wood can compensate for the distance differences between the pairs of magnets without the stringent manufacturing specifications of requiring exact distances between the magnets. When the cyanoacrylate adhesive is applied to the wood spacer, the adhesive can quickly cure (e.g., cure in seconds or a few minutes), and a hard, rigid bond is formed between. As a result, the disclosed technique can keep the magnets attached to the stator, keep the magnets separated, and keep the magnets aligned to each other while permitting the transducer to achieve a high sensitivity by using neodymium magnets.

Figure 1B:
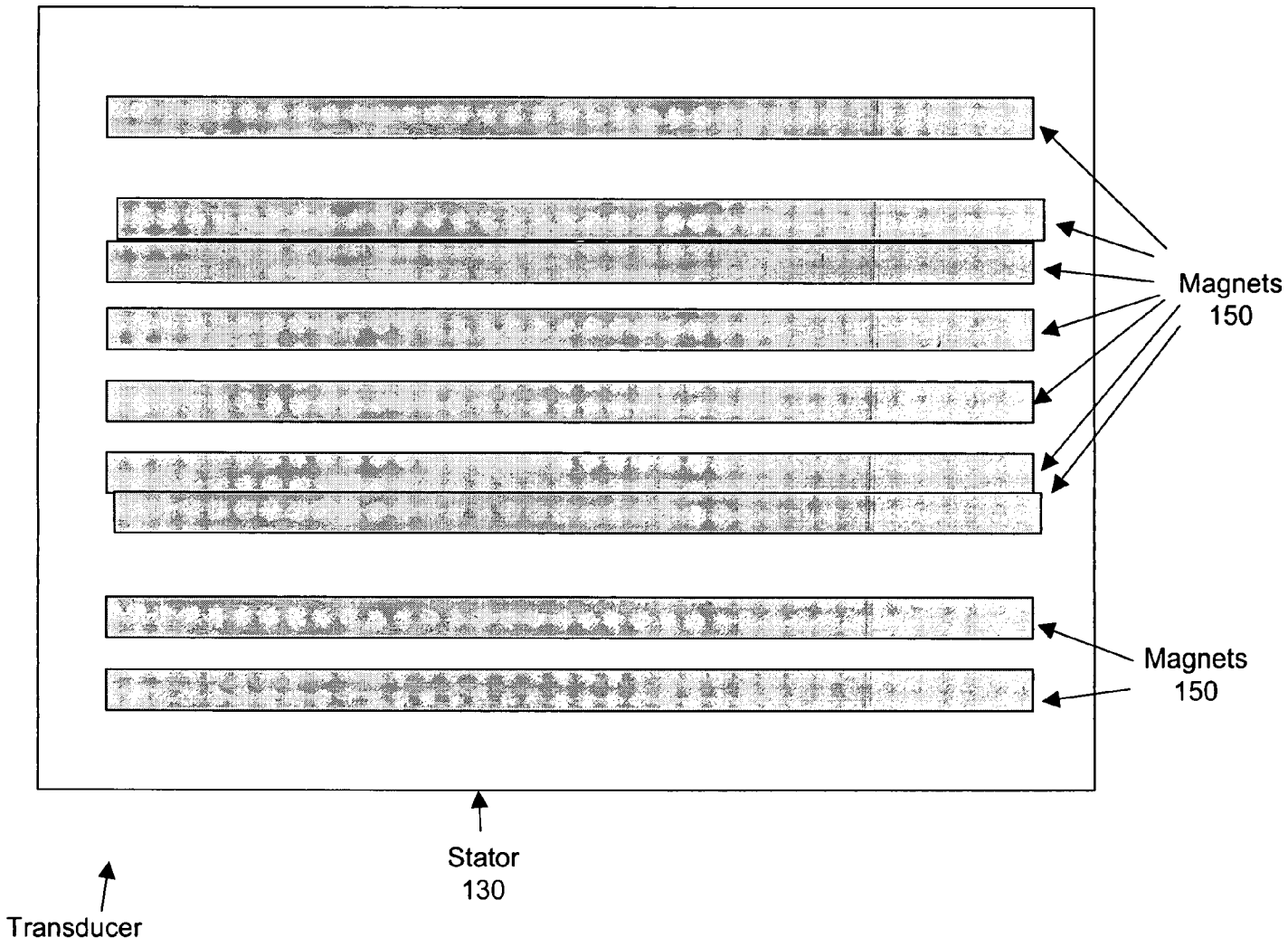
FIG. 1B is a diagram that illustrates a top view of the planar magnetic transducer with magnets that are detached from the stator when no spacers are used between the magnets.

FIG. 1B illustrates a top view of one half of a planar magnetic transducer 120 in which one or more magnets 150 become detached from the stator 130 when no spacers are used between the magnets. Even though the magnets 150 may be glued to the stator 130, the magnets 150 may become detached from the stator due to an external force, such as dropping the stator or nudging the magnets. The dislocated magnets are magnetically attached to other magnets on the stator.

Figure 2A:
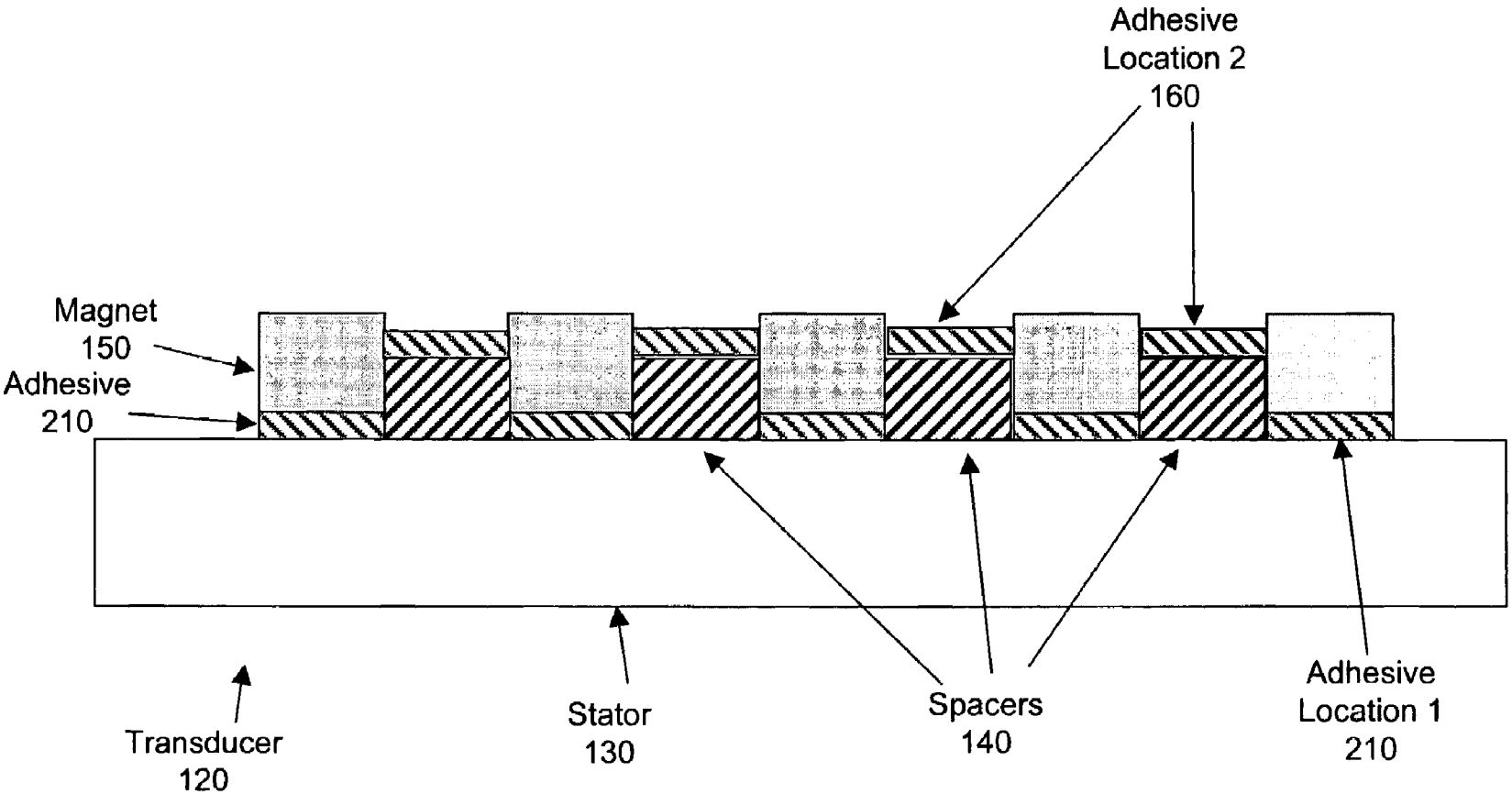
FIG. 2A is a diagram that illustrates a side view of the planar magnetic transducer.

FIG. 2A shows a diagram that illustrates a side view of one half of the planar magnetic transducer. As shown in FIG. 2A, the adhesive is placed in several locations: adhesive location 1 (210), underneath the magnets 150 to hold the stator; and adhesive location 2 (160), on top of the spacers 140 to form rigid spacers. The adhesive may also be applied between the wood spacers and the stator (not shown).

The height of the spacers 140 is equal or shorter than the height of the magnets 150, but may vary from the height shown. The shape of the magnets and the spacers are shown as three-dimensional rectangles or square-like shapes in FIGS. 1, 2A. As the separation distance between the magnets becomes smaller, the magnetic field becomes stronger and the acoustical output can be increased. The attraction and repelling forces between the neodymium magnets can be significant, and those forces can increase geometrically as the magnets are moved closer together.

Figure 2B:
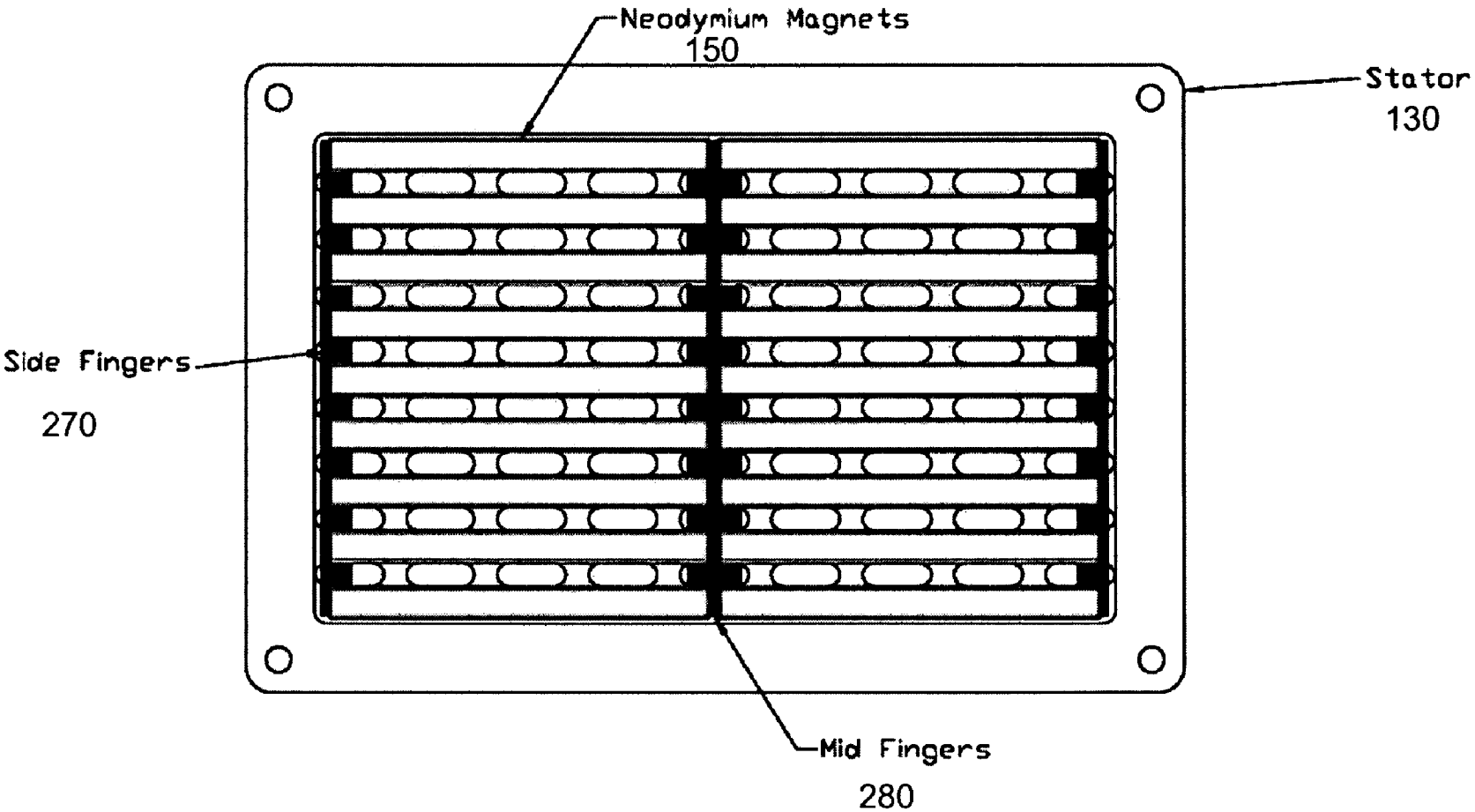
FIG. 2B is a diagram that illustrates a planar magnetic transducer with finger spacers.

The spacer shape is not limited to the spacer pieces as described in FIG. 1A, but may have other shapes. FIG. 2B shows a top view of a transducer with an array of magnets that have spacer structures 270, 280 that are in the form of "fingers" that extend along one or more rows of magnets to place a space between each pair of the magnets. The spacer may be side fingers 270 that contacts one end of each magnet in a given row and places a space between each magnet in that row. The spacer may also have mid-fingers 280 to separate the array of magnets. The mid-fingers 280 may contact one end of each magnet in an upper and lower row of magnets, and place spaces between each pair of magnets in the rows and spaces between each pair of magnets between the upper and lower rows.

In another implementation (not shown), the spacer may be in the form of "fingers" that extend along the length of the magnets so the entire gap between each pair of magnets is filled with the spacer. The spacer structure may be fingers that are formed of a single integrated piece that extends beyond the length of the parallel magnets, and the fingers are all joined at one or both ends of the magnets. The spacer structure may be a single integrated piece that has fingers to extend along the length of the magnets, so the entire gap between each pair of magnets is filled with the balsa wood spacer and the walls of each magnet is in contact with the single spacer piece. In another implementation (not shown), the stator itself may have built-in integrated features to serve as spacers and/or to constrain the magnets from shifting.

Figure 3:
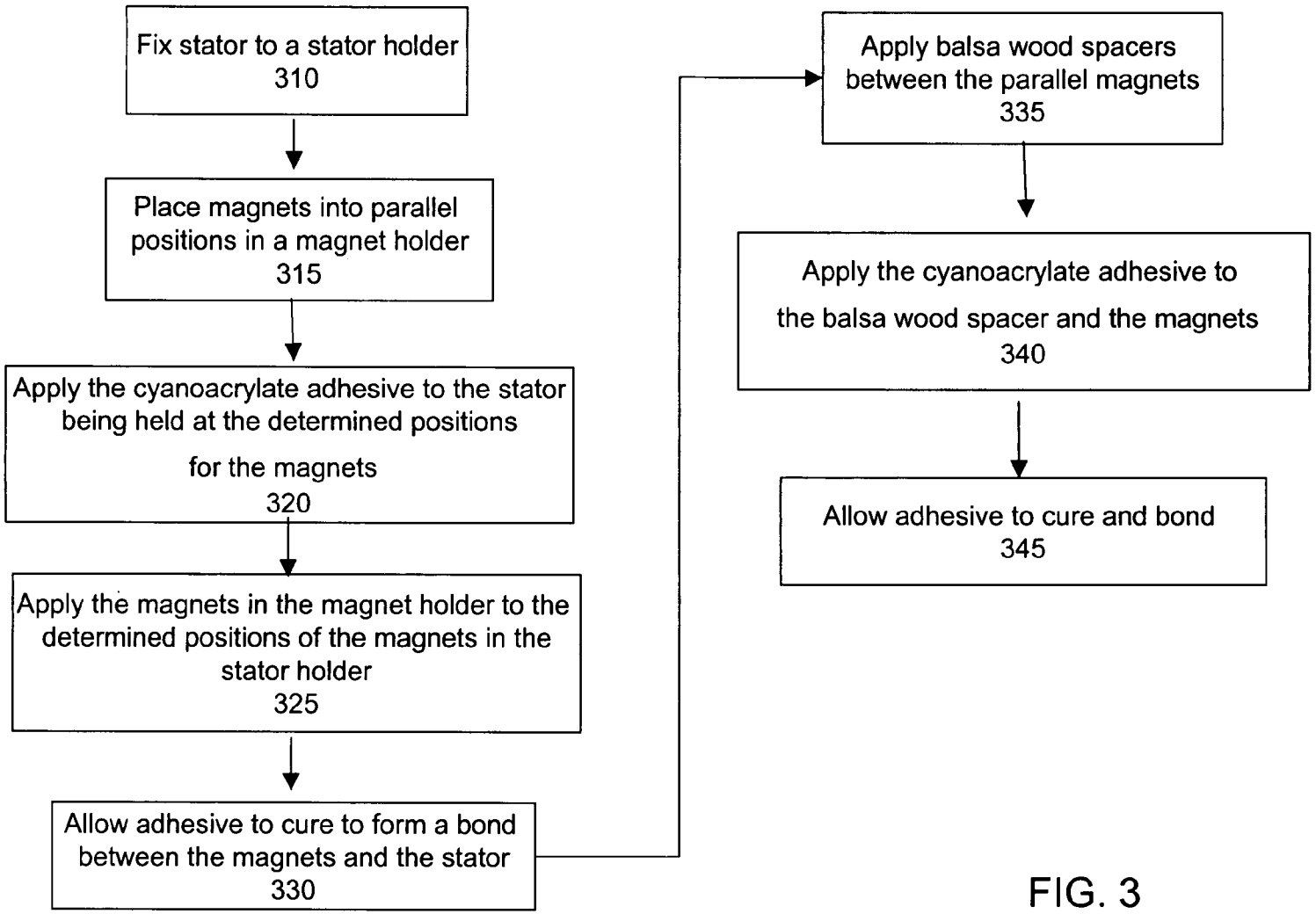
FIG. 3 shows an exemplary flow diagram for constructing the transducer.

FIG. 3 shows an exemplary flow diagram for constructing the transducer. The stator can be held in a stator holder while the transducer is being assembled (block 310). Magnets can be placed in positions in a magnet holder (block 315). Cyanoacrylate adhesive can be applied on the stator in the positions where the magnets will be aligned on the stator (block 320). The magnets in the magnet holders are then placed on their determined positions in the stator holder (block 325). As the magnets are drawn closer to the stator, there may be a point in time when the magnets jump from their positions in the magnet holder to their determined positions on the stator. So, the distances between pairs of magnets may not be exactly the same, although the distances can be approximately equal.

The adhesive is allowed to cure and form a bond between the magnets and the stator (block 330). The adhesive may air cure in a few seconds or a few minutes. The balsa wood spacers can be placed in between the parallel magnets (block 335). Cyanoacrylate adhesive can be applied all along the top of each of the wood spacers, as well as their contact locations with their respective magnets (block 340), as shown in FIG. 2A. The adhesive is allowed to cure and form a bond between the wood spacers and the magnets (block 345). The cyanoacrylate adhesive applied on the wood spacer can also form a hard, rigid structure when bonded. In one implementation, the cyanoacrylate adhesive applied on the wood spacer can be applied on the wood spacer with one or two drops of liquid cyanoacrylate adhesive.

Although only a few implementations have been described in detail above, other modifications are possible. There may be other materials used, and the construction of the transducer is not limited to the order described. For example, the stator can have a built-in channel to receive the fingers for the single, integrated spacer piece. In another example, the stator may have built-in features to serve as a spacer structure. Other materials having compressibility characteristics that are similar to balsa wood may be used in place of balsa wood, and other adhesives having bonding and curing characteristics similar to cyanoacrylate adhesive may be used in place of cyanoacrylate. The sizes and dimensions of the layers and structures in FIG. 1A may vary from the illustration shown. The magnets may or may not be in parallel with each other, and the distance of the spaces between the magnets can be different for each pair of magnets. The transducer structure may or may not have a damping cloth layer attached or bonded on the top surface of the magnets. Other implementations may be within the scope of the following claims.

What is claimed is:

1. A planar magnetic transducer apparatus, comprising:
a stator;
a plurality of magnets aligned in rows on the stator, wherein each pair of magnets is separated by a gap;
a plurality of spacers to fill each gap and separate each pair of magnets, wherein each of the plurality of spacers contacts at least one magnet, wherein one of the plurality of spacers comprises wood configured to be compressed between one of the pair of magnets to fill the gap between the one pair of magnets; and
an adhesive to bond the magnets to the stator and to bond each spacer between each pair of magnets.

2. A planar magnetic transducer apparatus, comprising:
a stator
a plurality of magnets aligned in rows on the stator, wherein each pair of magnets is separated by a gap;
a plurality of spacers to fill each gap and separate each pair of magnets, wherein each of the plurality of spacers contacts at least one magnet, wherein the spacers comprise balsa wood, and wherein the balsa wood is configured to take the shape of the gap; and
an adhesive to bond the magnets to the stator and to bond each spacer between each pair of magnets.

3. A planar magnetic transducer apparatus, comprising:
a stator
a plurality of magnets aligned in rows on the stator, wherein each pair of magnets is separated by a gap;
a plurality of spacers to fill each gap and separate each pair of magnets, wherein each of the plurality of spacers contacts at least one magnet, wherein each of the plurality of spacers comprises balsa wood; and
an adhesive to bond the magnets to the stator and to bond each spacer between each pair of magnets.

4. The apparatus of claim 3, wherein the adhesive comprises a reactive adhesive.

5. The apparatus of claim 3, wherein each magnet is aligned in parallel with another magnet.

6. The apparatus of claim 3, wherein each of the plurality of magnets comprises neodymium.

7. The apparatus of claim 3, wherein each gap comprises a similar distance.

8. The apparatus of claim 3, wherein adhesive comprises a cyanoacrylate adhesive.

9. The apparatus of claim 8, wherein the cyanoacrylate adhesive is to cure and form a rigid bond.

10. The apparatus of claim 3, wherein each of the plurality of spacers comprises a finger-like structure that extends along one or more rows of magnets to place a gap between each pair of magnets.

11. The apparatus of claim 3, wherein at least one spacer comprises side fingers that contact one end of each magnet in a row and place a gap between each magnet in the row.

12. The apparatus of claim 3, further comprising an array of magnets with at least two rows of magnets.

13. The apparatus of claim 12, wherein at least one spacer comprises mid-fingers to separate magnets in the array, wherein the mid-fingers contact one end of each magnet in an upper row of magnets and a lower row of magnets, and wherein the mid-fingers place gaps between each pair of magnets in each of the rows and places gaps between each pair of magnets between the upper and lower rows.

14. The apparatus of claim 3, wherein at least one spacer comprises fingers that extend along the length of the magnets so the gap between each pair of magnets is separated by the spacer.

15. The apparatus of claim 14, wherein the spacer comprising fingers is a single integrated structure.

16. The apparatus of claim 3, wherein the stator comprises one or more built-in spacer structures to place a gap between each of the magnets.

17. An audio system, comprising:

a planar magnetic transducer configured to generate high output, the planar magnetic transducer comprising:

a plurality of neodymium magnets aligned in rows on a stator, wherein each neodymium magnet is aligned with another neodymium magnet, and wherein each pair of neodymium magnets is separated by a gap;

a plurality of balsa wood spacers to fill each gap and separate each pair of neodymium magnets, wherein each of the plurality of balsa wood spacers contacts at least one neodymium magnet; and cyanoacrylate adhesive to bond the neodymium magnets to the stator and to bond each balsa wood spacer between each pair of neodymium magnets.

18. The system of claim 17, wherein the cyanoacrylate adhesive is to reliably hold the plurality of neodymium magnets to the stator when the transducer generates high output.

19. A planar magnetic transducer apparatus, comprising:

a stator;

a plurality of magnets aligned in rows on the stator and separated from each other with a gap;

a plurality of spacers arranged to fill each gap between adjacent pairs of magnets, wherein one of the plurality of spacers is electrically-insulating and configured to be compressed and deformed between one pair of magnets to fill the gap between the one pair of magnets; and an adhesive to bond the plurality of magnets to the stator and to bond the plurality of spacers between the adjacent pairs of magnets.

20. The apparatus of claim 19, wherein the one of the plurality of spacers is further configured to absorb a portion of the adhesive for the bond.

21. The apparatus of claim 19, wherein the adhesive comprises a cyanoacrylate adhesive.

22. The apparatus of claim 21, wherein the one pair of magnets comprises neodymium magnets.

* * * * *